US008472639B2

(12) United States Patent
Reining

(10) Patent No.: US 8,472,639 B2
(45) Date of Patent: Jun. 25, 2013

(54) MICROPHONE ARRANGEMENT HAVING MORE THAN ONE PRESSURE GRADIENT TRANSDUCER

(75) Inventor: Friedrich Reining, Vienna (AT)

(73) Assignee: AKG Acoustics GmbH, Vienna (AT)

( * ) Notice: Subject to any disclaimer, the term of this patent is extended or adjusted under 35 U.S.C. 154(b) by 1069 days.

(21) Appl. No.: 12/391,059

(22) Filed: Feb. 23, 2009

(65) Prior Publication Data

US 2009/0190777 A1 Jul. 30, 2009

(30) Foreign Application Priority Data

Nov. 13, 2007 (WO) ..... PCT/AT2007/000514

(51) Int. Cl.
*H04R 9/08* (2006.01)

(52) U.S. Cl.
USPC ..... 381/92; 381/122; 381/357

(58) Field of Classification Search
USPC ..... 381/92, 122, 174, 357
See application file for complete search history.

(56) References Cited

U.S. PATENT DOCUMENTS

| | | | | |
|---|---|---|---|---|
| 3,008,014 | A | 11/1961 | Williamson et al. | |
| 4,042,779 | A | 8/1977 | Craven et al. | |
| 4,399,327 | A | 8/1983 | Yamamoto et al. | |
| 6,041,127 | A | 3/2000 | Elko | |
| 6,885,751 | B2 * | 4/2005 | Pribyl | 381/174 |
| 2001/0016020 | A1 | 8/2001 | Gustafsson et al. | |
| 2001/0046306 | A1 | 11/2001 | Barnert | |
| 2002/0114476 | A1 | 8/2002 | Pavlovic et al. | |
| 2003/0053649 | A1 | 3/2003 | Pribyl | |
| 2003/0174852 | A1 | 9/2003 | Klinke | |
| 2003/0179890 | A1 | 9/2003 | Matsuo | |
| 2003/0209383 | A1 | 11/2003 | Whitman Fox et al. | |
| 2007/0009115 | A1 * | 1/2007 | Reining et al. | 381/122 |
| 2007/0009116 | A1 | 1/2007 | Reining | |
| 2009/0190775 | A1 | 7/2009 | Reining | |
| 2009/0190776 | A1 | 7/2009 | Reining | |

(Continued)

FOREIGN PATENT DOCUMENTS

| | | |
|---|---|---|
| DE | 25 31 161 C1 | 1/1976 |
| DE | 30 03 178 A1 | 8/1981 |

(Continued)

OTHER PUBLICATIONS

International Searching Authority, the corresponding International Search Report dated Jul. 25, 2008, of Application No. PCT/AT2007/000514, and Written Opinion.

(Continued)

*Primary Examiner* — Marcos D. Pizarro
*Assistant Examiner* — Tifney L Skyles
(74) *Attorney, Agent, or Firm* — Brinks Hofer Gilson & Lione

(57) ABSTRACT

A microphone arrangement includes multiple pressure gradient transducers having an acoustic center, a first sound inlet opening leading to a front of a diaphragm, and a second sound inlet opening leading the back of the diaphragm. A directional characteristic of the pressure gradient transducers includes an omni portion and a figure-eight portion. The pressure gradient transducers have a direction of maximum sensitivity in a main direction. Each main direction of the pressure gradient transducers is inclined. The acoustic center of a pressure transducer and the pressure gradient transducers are positioned within an imaginary sphere having a radius that corresponds to double the largest dimension of the diaphragm of one of the transducers.

15 Claims, 14 Drawing Sheets

U.S. PATENT DOCUMENTS

| | | | |
|---|---|---|---|
| 2009/0190777 | A1 | 7/2009 | Reining |
| 2009/0214053 | A1 | 8/2009 | Reining |
| 2009/0214062 | A1 | 8/2009 | Reining |
| 2009/0268925 | A1 | 10/2009 | Reining |

FOREIGN PATENT DOCUMENTS

| | | | |
|---|---|---|---|
| DE | 20 2005 002 446 | U1 | 5/2005 |
| EP | 0 374 902 | A | 6/1990 |
| EP | 0 869 697 | A2 | 10/1998 |
| EP | 0 997 055 | A | 5/2000 |
| EP | 1 351 549 | A2 | 8/2003 |
| EP | 1 737 268 | A | 12/2006 |
| EP | 1 737 271 | A | 12/2006 |
| GB | 0344967 | | 3/1931 |
| GB | 1512514 | | 6/1978 |
| JP | 57148500 | A | 9/1982 |
| WO | WO 2004/084577 | A1 | 9/2004 |
| WO | WO 2006/123263 | A | 11/2006 |
| WO | WO 2006/125870 | A | 11/2006 |

OTHER PUBLICATIONS

International Searching Authority, the corresponding International Search Report dated Jul. 25, 2008, of Application No. PCT/AT2007/000513, and Written Opinion.

Malham, Dave. "The Role of the Single Point Soundfield Microphone in Surround Sound Systems" *The University of York* York, UK (1998) 6.

Jacobsen, Finn; Barrera-Figueroa, Salvador; Rasmussen, Knud; "A note on the concept of acoustic center" *Acoustical Society of America Journal* vol. 115 (2004) 1468-1473.

Barrera-Figueroa and Rasmussen, Knud "The acoustic center of laboratory standard microphones" *The Journal of the Acoustical Society of America* vol. 120 (2006) 2668-2675.

USPTO Office Action from U.S. Appl. No. 12/391,038, dated Mar. 13, 2012.

USPTO Office Action from U.S. Appl. No. 12/391,004, dated Feb. 28, 2012.

USPTO Office Action from U.S. Appl. No. 12/391,015, dated Feb. 3, 2012.

USPTO Office Action from U.S. Appl. No. 12/391,030, dated Jan. 4, 2012.

USPTO Office Action from U.S. Appl. No. 12/390,990, dated Nov. 23, 2011.

USPTO Office Action from U.S. Appl. No. 11/474,124, dated Jan. 3, 2011.

USPTO Office Action from U.S. Appl. No. 11/474,124, dated Apr. 27, 2010.

International Preliminary Report on Patentability and Written Opinion, dated May 18, 2010, of Application No. PCT/AT2007/000511.

Jürgen Köller, Tetrahedron, 2001. Retrieved on Apr. 23, 2010 from http://wvvw.mathematische-basteleien.de/tetrahedron.htm) 6.

International Searching Authority, the corresponding International Search Report and Written Opinion dated Oct. 24, 2008, for Application No. PCT/AT2008/000061.

International Searching Authority, the corresponding International Search Report dated Sep. 12, 2008, for Application No. PCT/AT2007/000542.

International Searching Authority, the corresponding International Search Report and Written Opinion, dated Jul. 30, 2008, of Application No. PCT/AT2007/000511.

International Searching Authority, the corresponding International Search Report and Written Opinion dated Jul. 25, 2008, of Application No. PCT/AT2007/000510.

International Searching Authority, the corresponding International Search Report and Written Opinion dated Oct. 31, 2005, of Application No. EP 05 45 0110.

Cotterell, Philip S. "On the Theory of the Second-Order Sound Field Microphone" *Department of Cybernetics* (2002) 187.

Proakis, John G.; and Manolakis, Dimitris G.; "Digital Signal Processing" (Prentice Hall) 430-433.

* cited by examiner

MICROPHONE ARRANGEMENT HAVING MORE THAN ONE PRESSURE GRADIENT TRANSDUCER

PRIORITY CLAIM

This application claims the benefit of priority from PCT/AT2007/000514, filed Nov. 13, 2007, which is incorporated by reference.

BACKGROUND OF THE INVENTION

1. Technical Field

This disclosure relates to devices that convert sound into operating signals and more specifically to microphones having multiple microphone arrangements.

2. Related Art

A coincident arrangement of gradient transducers may form a soundfield microphone (or B-format microphone). A soundfield microphone includes four pressure gradient capsules. The individual capsules are arranged in a tetrahedral form with the diaphragms of the individual capsules parallel to the imaginary surfaces of a tetrahedron. Each pressure gradient receivers delivers signals A, B, C or D and has a directional characteristic deviating from a sphere. The characteristic may be represented by $k+(1-k)\times\cos(\theta)$. $\theta$ denotes the azimuth, under which the capsule is exposed to sound. k indicates a percentage of omni signal (in a sphere, k=1, in a figure-of-eight, k=0). The signals of the individual capsules maybe denoted A, B, C and D. The axis of symmetry of directional characteristic of each individual microphone is perpendicular to the diaphragm and to the corresponding surface of the tetrahedron. The axes of symmetry of the directional characteristic of each individual capsule may form an angle of about 109.5° with each other.

According to one calculation, the four individual capsule signals maybe converted to a B-format (W, X, Y, Z):

$$W=\tfrac{1}{2}(A+B+C+D)$$

$$X=\tfrac{1}{2}(A+B-C-D)$$

$$Y=\tfrac{1}{2}(-A+B+C-D)$$

$$Z=\tfrac{1}{2}(-A+B-C+D)$$

The forming signals may form a sphere (W) and three figure-eights (X, Y, Z) that are orthogonal to each other. To configure the frequency and phase response of the directions, so that a flat energy characteristic is achieved with respect to the frequencies in the audible range, the signals W, X, Y, Z may be equalized. For a zero-order signal (W) and the first-order signals X, Y, Z, theoretical equalization characteristics depend on the frequency and effective distance of the center of the microphone capsules from the center of the tetrahedron.

The main directions of the figure eight X, Y, Z are normal to the sides of a cube enclosing the tetrahedron. By linear combination of at least two of these B-format signals, an arbitrary microphone capsule may be synthesized. Deviations from the theory based on the use of real capsules and the failure to satisfy ideally the coincidence requirement cause the performance of the synthesized microphones to deteriorate.

Synthesizing or modeling of the microphone may occur precisely in that the omni signal W is combined with one or more of the signals X, Y, Z, taking into account a linear weighting factor "r". For directional characteristics in the area between a sphere and a cardioid, this may be derived for a synthesized capsule in the X-direction through the formula $M=W+r\times X$, in which r can assume arbitrary values >0. The level of the signal M obtained may be normalized, so that the desired frequency trend is obtained for the main direction of the synthesized capsule. If a synthesized capsule is analyzed in any direction, additional weighting factors may be used, since rotation of the synthesized capsule in any direction may occur through a linear combination of three orthogonal figure-eights (X, Y, Z).

In a soundfield microphone the directional characteristic of the entire microphone may be adjusted. The microphone may be adapted even during playback or a final production of a sound carrier. It is possible to focus on a corresponding soloist of an ensemble, to mask out unexpected and undesired sound events by influencing the directional characteristic, or to follow a moving sound source (for example, a performer on the stage), so that the recording quality remains independent of the changed position of the sound source.

When sound is recorded from a soundfield microphone, the entire sound field may be described at any location in time. Time differences, etc., may be analyzed during selected evaluations. When deviations occur, the coincidence conditions for small wavelengths may no longer be satisfied. Distortions and artifacts may occur with respect to the frequency response and directional characteristic of a synthesized signal. A rotation of each individual gradient capsule of the soundfield microphone of about 180°, so that each of the four diaphragm surfaces is brought closer to the center, has shown that artifacts may not be eliminated at higher frequencies. Acoustic shadowing of the front microphone mouthpieces may not alter the limit frequency, up to which the calculation method applies.

There is a trade-off between the coincidence requirement and the attainable noise distance of the employed gradient capsules. The larger the individual diaphragm surface, the more noise distance may be achieved. However, this relationship leads to a larger distance of the diaphragm surfaces to the center of the arrangement. An optimal solution requires positioning of the four individual capsules as closely as possible to each other, so that the sound inlet on the back of the gradient transducer is influenced by the resulting structure of the closely positioned capsules. This means that the cavity formed in the interior of the microphone arrangement, and naturally also its delimitation by the microphone arrangement, as well as its mounts, etc., will act as an acoustic filter. The acoustic filter may affect the acoustic filtering by the sound paths that lead to the back of the individual capsules. The effect of this additional acoustic filter is frequency-dependent and may have its strongest effect at frequencies at which the wavelength of the sound is about the same order as the dimensions of the diaphragm or the dimensions of the entire soundfield microphone. In some soundfield microphones, this effect may occur in the frequency range around 10 kHz, at which rejection, (e.g., the frequency response from the direction from which the individual capsule is least sensitive becomes weakest and, drops below 10 dB).

In some soundfield microphones, two of the capsules may be situated with their main direction positioned downward, which means that they may be particularly sensitive to non-ideal microphone mounting or fastening under practical conditions. Such acoustic disturbances, based on the capsule arrangement, may develop due to reflections on the mounting material, on the floor, etc. In addition, the capsules in the close arrangement may be influenced when the theoretically rotationally symmetric directional characteristic of the synthesized omni signal is disturbed.

In some soundfield microphones a common configuration (X-Y-plane) is achieved by switching four capsule signals. The B-format signals in the X-Y-plane may be formed from microphone signals that meet at an angle of about 54° in each capsule under the influence of sound. If a directional diagram of a gradient transducer is considered, scattering of the rejection angle of the individual capsules may have a stronger effect, as the inlet direction deviates from the main direction. If two capsules with slightly different polar patterns exposed to sound from 0° differ only by the sensitivity described, at angles greater than 0°, the difference is increased by a percentage as a result of the difference in rejection angles.

SUMMARY

A microphone arrangement includes pressure gradient transducers having an acoustic center, a first sound inlet opening leading to a front of a diaphragm, and a second sound inlet opening leading the back of the diaphragm. A directional characteristic of the pressure gradient transducers includes an omni portion and a figure-eight portion. The pressure gradient transducers have a direction of maximum sensitivity in a main direction. Each main direction of the pressure gradient transducers is inclined. The acoustic center of a pressure transducer and the pressure gradient transducers are positioned within an imaginary sphere having radius that corresponds to about double the largest dimension of the diaphragm of one of the transducers.

Other systems, methods, features, and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

A microphone arrangement converts individual transducers signals into a B-format. Coincidence may be ensured or improved. Shadowing effects that may arise when the individual capsules shadow may be reduced or substantially attenuated. Acoustic disturbances from spatial conditions near the microphone arrangement and the dependence on capsule tolerances (for example, deviations in the manufacturing process) may be minimized.

In some microphone arrangements the acoustic centers of the pressure gradient capsules and the pressure transducer lie within an imaginary sphere whose radius corresponds to about double the largest dimension of the diaphragm of a gradient and/or pressure transducer. The criterion ensures the coincident position of the transducers. The acoustic centers of the pressure gradient transducers and the pressure transducer lie within an imaginary sphere whose radius corresponds to the largest dimension of the diaphragm of a transducer. Coincidence may increase by moving the sound inlet openings together.

"Synthesized directional characteristic" is a combination of individual B-format signals, for example, a sphere (W) with at least one additional B-format signal (a figure-eight), and also their further processing, such as equalization, bundling, rotation, etc. The individual signals may be processed by a weighting of the signals.

The expression "directional characteristic" is not only the directional characteristic of the real capsules, but of signals in general. These signals may be comprised of other signals (for example, B-format signals) and have complicated multiple directional characteristics. If such directional characteristics may not be achieved with individual capsules, the expression "directional characteristic" is used to establish from which spatial areas the formed or synthesized signals preferably yield acoustic information.

Figure 1:
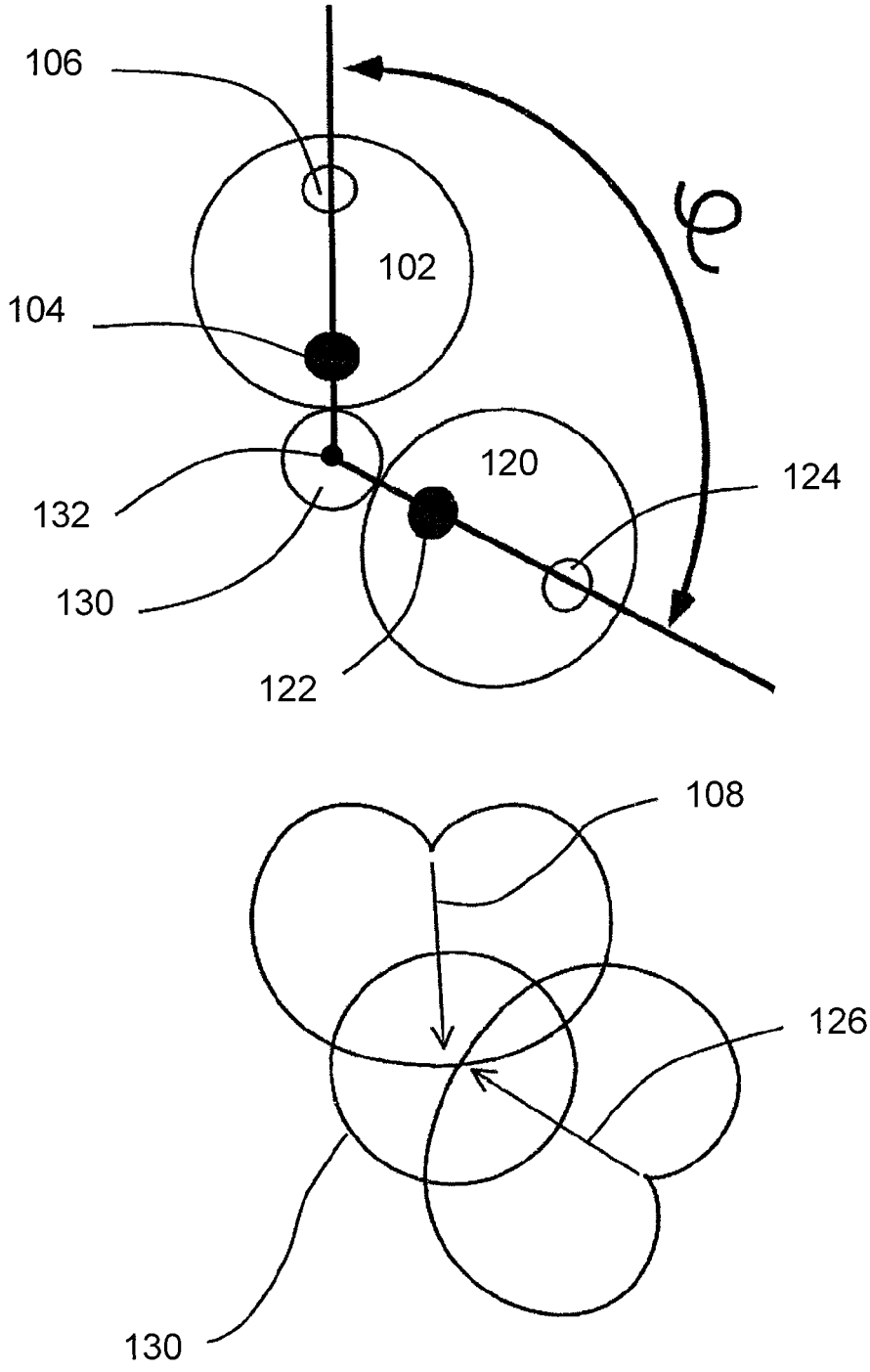
FIG. 1 is a microphone arrangement.

FIG. 1 is a microphone arrangement comprising two pressure gradient transducers 102 and 120 and a pressure transducer 130. The directional characteristic of the pressure gradient transducer may include an omni portion and a figure-eight portion. This directional characteristic may be represented as $P(\theta)=k+(1-k)\times\cos(\theta)$, in which k denotes the angle-independent omni portion and $(1-k)\times\cos(\theta)$ denotes the angle-dependent figure eight-portion. In FIG. 1, the microphone arrangement may include a gradient transducer that renders a cardioid characteristic. Alternative arrangements may generate other characteristics. The characteristics may be derived from the combination of a sphere and figure-eight, for example, (e.g., hypercardioids, supercardoid, shotgun, etc).

The directional characteristic of the pressure transducer 130 may comprise an omni characteristic. Deviations from an omni shape may occur at higher frequencies due to variances in manufacturing tolerances and quality. In these arrangements directional characteristics may be described as a sphere or sphere like. A pressure transducer, in contrast to the gradient transducer, has only one sound inlet opening. The deflection of the diaphragm is proportional to pressure.

Deflection may not occur due to a pressure gradient, between the front and back of the diaphragm.

The gradient transducers 102 and 120 may lie in a two dimensional plane (e.g., an x-y-plane). The main directions 108, 126 (the directions of maximum sensitivity) are inclined relative to each other by the azimuthal angle ϕ (lower portion of FIG. 1). The angle ϕ between two main directions preferably takes on values between about 30° and about 150°. A preferred angle lies at about 90°. At 90°, two signals are orthogonal to each other. In alternative systems any type of gradient transducer may be used including a flat transducer or boundary microphone, in which the two sound inlet directions lie on the same side surface, e.g., the boundary.

Figure 7:
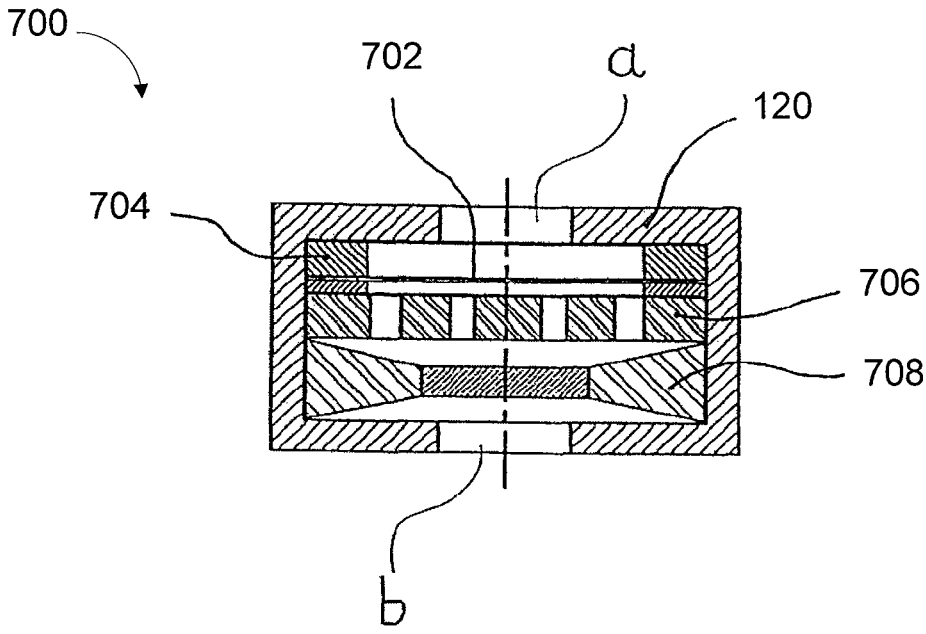
FIG. 7 is a gradient transducer with sound inlet openings on opposite sides of a capsule housing.
Figure 8:
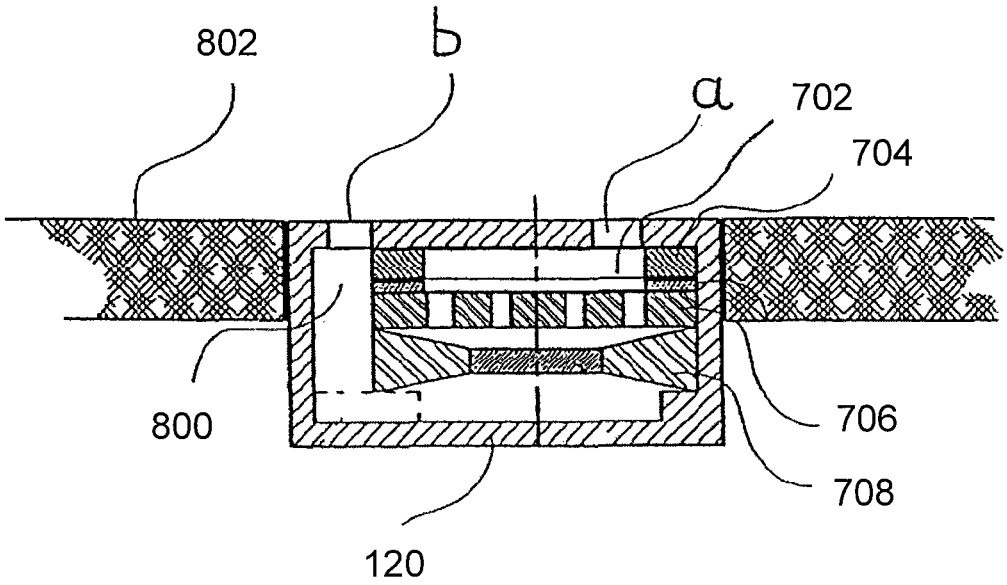
FIG. 8 is a gradient transducer with sound inlet openings on the same side of the capsule housing.

FIG. 7 and FIG. 8 show the difference between a "normal" gradient capsule and a "flat" gradient capsule. In FIG. 7, a sound inlet opening "a" is situated on the front of the capsule housing 700 and a second sound inlet opening "b" is situated on the opposite back side of the capsule housing 700. The front sound inlet opening "a" is connected to the front of diaphragm 702, which is tightened through a diaphragm ring 704, and the back sound inlet opening "b" is connected to the back of diaphragm 702. In the pressure gradient capsules the front of the diaphragm may receive sound with little resistance (e.g., relatively unhampered). The back of the diaphragm of the pressure gradient may only be reached through the passage of an acoustically phase-rotating element of the sound. In many microphone arrangements, the sound path to the front is shorter than the sound path to the back. The arrows show the path of the sound waves to the front or back of the diaphragm 702 in FIG. 9. In the area behind electrode 706, there may be an acoustic friction element 8. The acoustic friction element may form of a constriction. It may comprise a non-woven material or a foam, for example.

In the flat gradient capsule of FIG. 8, (e.g., a boundary microphone) sound inlet openings a, b are positioned on the front of the capsule housing 700, in which one leads to the front of diaphragm 702 and the other leads to the back of diaphragm 700 through a sound channel 800. The transducer may be incorporated in a boundary 802, like, a console of a vehicle. The acoustic friction element 708 may comprise, for example, a non-woven element, a foam material, constrictions, perforated plates, etc., that may be arranged in the area next to diaphragm 702. The acoustic friction element 708 may take a very flat form.

By arranging inlet openings a, b on one side of the capsule, a directional characteristic asymmetric to the diaphragm axis may be generated, (e.g. cardioid, hypercardioid, etc.). The capsules may include characteristics described in EP 1 351 549 A2 and the corresponding U.S. Pat. No. 6,885,751 A, which are incorporated by reference.

Figure 9:
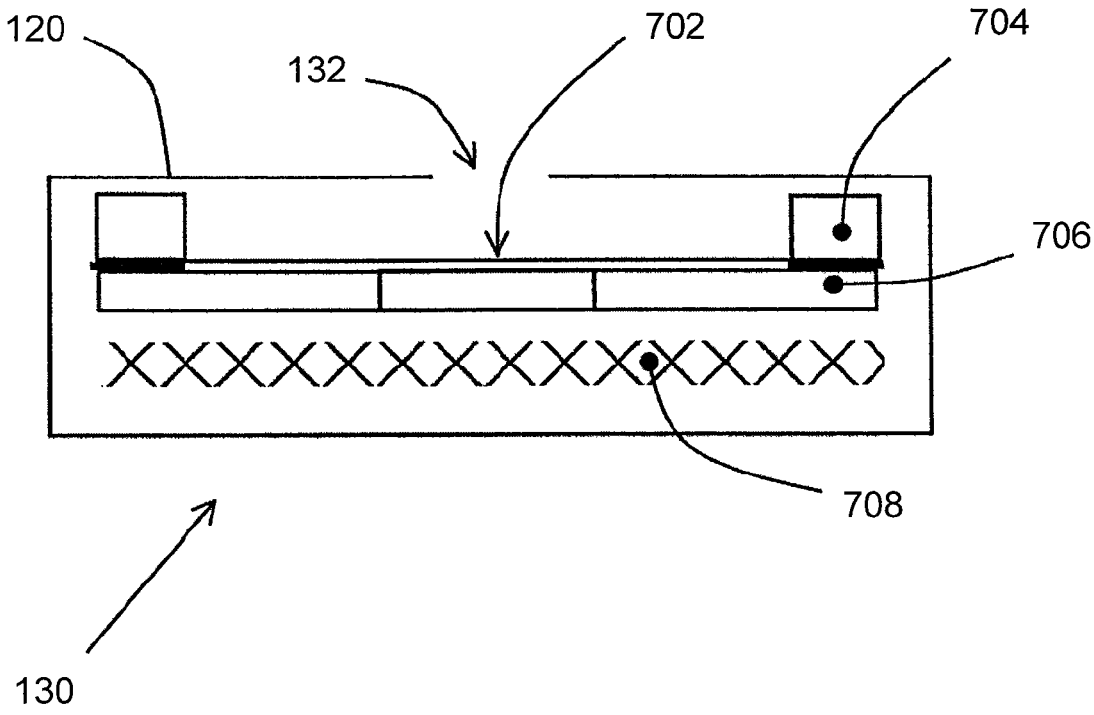
FIG. 9 is a pressure transducer in cross-section.

A pressure transducer, or a zero-order transducer, is shown in FIG. 9. In this arrangement, the front of the diaphragm 702 is connected to the surroundings in zero-order transducers. The back faces a closed volume. The pressure transducer has an essentially omni directional characteristic. Slight deviations are obtained as a function of the frequency.

In FIG. 1, two gradient capsules 102, 120 are oriented toward each other. The sound inlet openings 104 and 122 leading to the front of the corresponding diaphragm lie adjacent or very near each other and the sound inlet openings 106, 124 leading to the back of the diaphragm lie on the periphery of the arrangement. The point of intersection of the lengthened connection lines that join the front sound inlet opening 104 and 122 to the rear sound inlet opening 106 and 124 is viewed as the center of the microphone arrangement. In the lower portion of FIG. 1, this is the center, toward which the main directions 108 and 126 are directed. The front sound inlet openings 104, 122 of the two transducers 102 and 120, or mouthpieces are situated in the center area of the arrangement. The coincidence of the two transducers may be strongly influenced by this arrangement. The pressure transducer 130 is now situated in the center area of the microphone arrangement, in which the single-sound inlet opening of the pressure transducer 130 is preferably situated at the intersection of the connection lines of the sound inlet openings of pressure gradient transducers 102, 120.

Coincidence may occur due to the acoustic centers of the gradient transducers 102, 120 and the pressure transducer 130 that may be positioned together. In some arrangements, the center may occur at a common or same point. The acoustic center of a reciprocal transducer may be the point from which omni waves seem to be diverging when the transducer is acting as a sound source. "A note on the concept of acoustic center", by Jacobsen, Finn; Barrera Figueroa, Salvador; Rasmussen, Knud; Acoustical Society of America Journal, Volume 115, Issue 4, pp. 1468-1473 (2004), which is incorporated by references, examines various ways of determining the acoustic center of a source, including methods based on deviations from the inverse distance law and methods based on the phase response. "The acoustic center of laboratory standard microphones" by Salvador Barrera-Figureueroa and Knud Rasmussen; The Journal of the Acoustical Society of America, Volume 120, Issue 5, pp. 2668-2675 (2006), which is incorporated by reference also describes how acoustic centers may be identified.

The acoustic center may be determined by measuring spherical wave fronts during sinusoidal excitation of the acoustic transducer. The measurement may occur at a selected frequency in a certain direction and at a certain distance from the transducer in a small spatial area. The area may be an observation point. Analyses of the spherical wave fronts may identify the center of the omni wave—the acoustic center.

For a reciprocal transducer, such as a condenser microphone, the transducer may be operated as a sound emitter or sound receiver. The acoustic center may be identified by:

$$p(r) = j\frac{\rho * f}{2 * r_t} M_f * i * e^{-\gamma * r_i} \tag{1}$$

$r_i$ … Acoustic center $\rho$ … Density of air $f$ … Frequency $M_f$ … Microphone sensitivity $i$ … Current $\gamma$ … Complex wave propagation coefficient In pressure receivers exclusively, the center may comprise average frequencies (in the range of 1 kHz), that may deviate at high frequencies. The acoustic center may occur in a small area. The acoustic center of gradient transducers may be identified by a different approach, since formula (1) does not consider the near-field-specific dependences. The location of an acoustic center may also be identified by locating the point in which a transducer must be rotated to observe the same phase of the wave front at the observation point.

In a gradient transducer an accurate center may be identified through a rotational symmetry. The acoustic center may be situated on a line normal to the diaphragm plane. The center point on the line may be determined by two measurements, at a point most favorably from the main direction of about 0°, and at a point of about 180°. In addition to the phase responses of these two measurements, for an average estimate of the acoustic center in the time range used, one method alters the rotation point around which the transducer is rotated between measurements. The adjustment may ensure that the impulse responses are maximally congruent (e.g., so that the maximum correlation between the two impulse responses lies in the center).

In some microphone arrangements, in which the two sound inlet openings are situated on a boundary, the acoustic center may not be the diaphragm center. The acoustic center may lie closest to the sound inlet opening that leads to the front of the diaphragm. This forms the shortest connection between the boundary and the diaphragm. In other arrangements, the acoustic center could also lie outside of the capsule.

When using an additional pressure transducer, separation may be considered. A prerequisite for separation of the omni signal portion from the figure-eight signal portion of a pressure gradient capsule, through an external pressure transducer, in addition to coincidence, is also the constancy of the omni characteristic as a gauge of the quality of the obtainable separation of the omni signal portion and the figure-eight signal portion.

If one considers the diaphragm of a pressure transducer lying in the XY-plane, and refers to the angle that any direction in the XY-plane encloses with the X-axis is the azimuth, and refers to the angle that any direction encloses with the XY-plane as the elevation, the following may be practiced. The deviation of the pressure transducer signal from an ideal omni signal may be greater with an increasing frequency (for example, above 1 kHz), but increases much more strongly during sound exposure from different elevations. Based on these considerations, an alternative is obtained when the pressure transducer is arranged on a boundary, so that the diaphragm is substantially parallel to the boundary. In another alternative, the diaphragm lies as close as possible to the boundary, preferably aligned with it, but at least within a distance that corresponds to the maximum dimension of the diaphragm. Such alternatives yield a particularly high degree of separation quality of the omni signal portion and the figure-eight signal portion. The acoustic center for such incorporation lies in a line substantially normal to the diaphragm surface at or near the center of the diaphragm. The acoustic center, with good approximation, may lie on the diaphragm surface at the center.

The coincidence criterion requires, that the acoustic centers 1802, 1822, 1832 of the pressure gradient transducers 102, 120 and the pressure transducer 130 lie within an imaginary sphere O, whose radius R is double of the largest dimension D of the diaphragm of a transducer.

In some alternative microphone arrangements the acoustic centers of the pressure gradient transducers and the pressure transducer may lie within an imaginary sphere having radius corresponding to the largest dimension of the diaphragm of a transducer. By increasing the coincidence through movement of the sound inlet openings together, exceptional results may be achieved.

Figure 18:
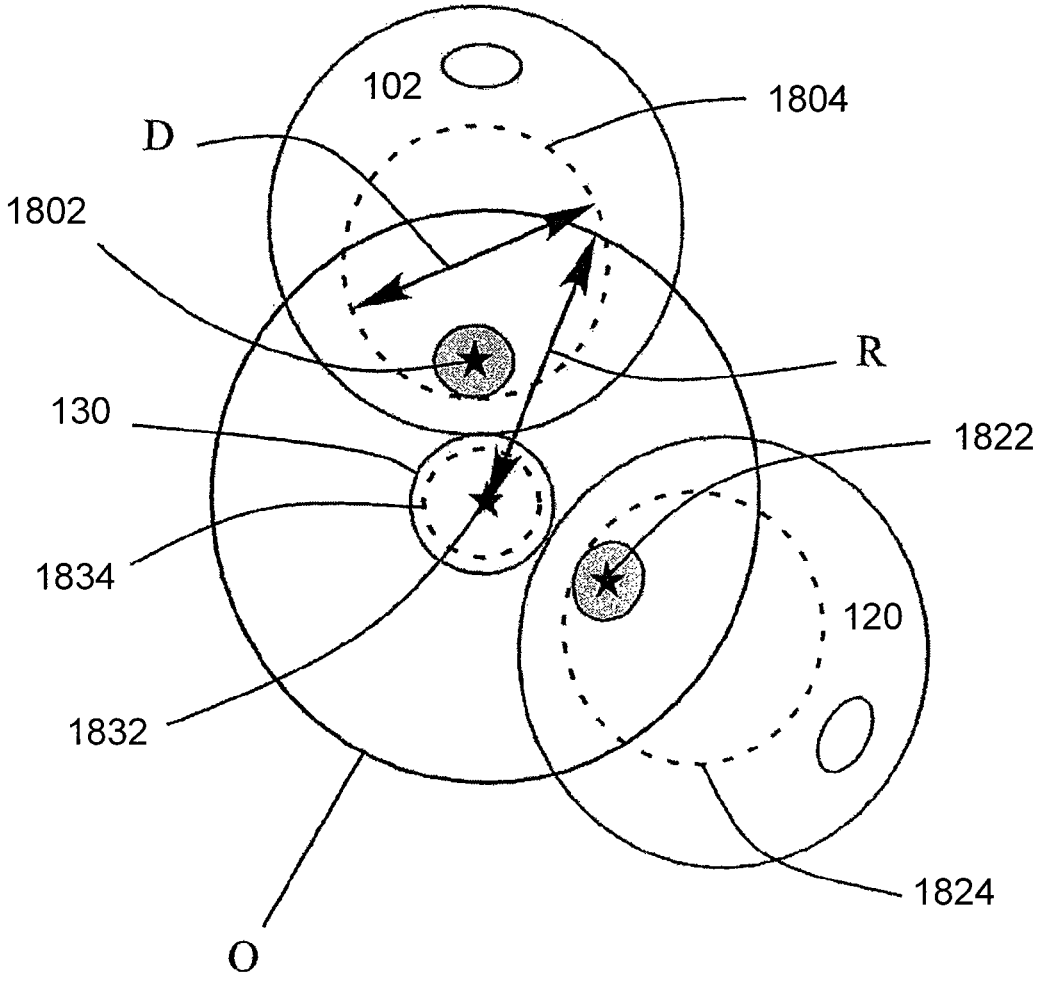
FIG. 18 shows coincidence.

To ensure a coincidence condition, the acoustic centers 1802, 1822, 1832 of the pressure gradient capsules 102 and 120 and the pressure transducer 130 lie within an imaginary sphere O, having a radius R equal to the largest dimension D of the diaphragm of a transducer. The size and position of the diaphragms 1804, 1824, 1834 are indicated in FIG. 18 by dashed lines.

In an alternative, this coincidence condition may also be established in that the first sound inlet openings 104, 122 and the sound inlet opening for the pressure transducer 130 lie within an imaginary sphere whose radius corresponds to the largest dimension of the diaphragm of a transducer. Since the size of the diaphragm determines the noise distance and therefore represents a direct criterion for designing the acoustic geometry. The largest diaphragm dimension (for example, the diameter in a round diaphragm, or a side length in a triangular or rectangular diaphragm) may determine the coincidence condition. In other systems the diaphragms 1804, 1824, 1834 do not have the same dimensions. In these systems, the largest diaphragm is used to determine the preferred criterion.

In the microphone arrangement of FIG. 1, the two gradient transducers 102, 120 are arranged in a plane. The connection lines of the individual transducers, which connect the front and rear sound inlet openings to each other, are inclined with respect to each other by an angle of about 120°.

Figure 4:
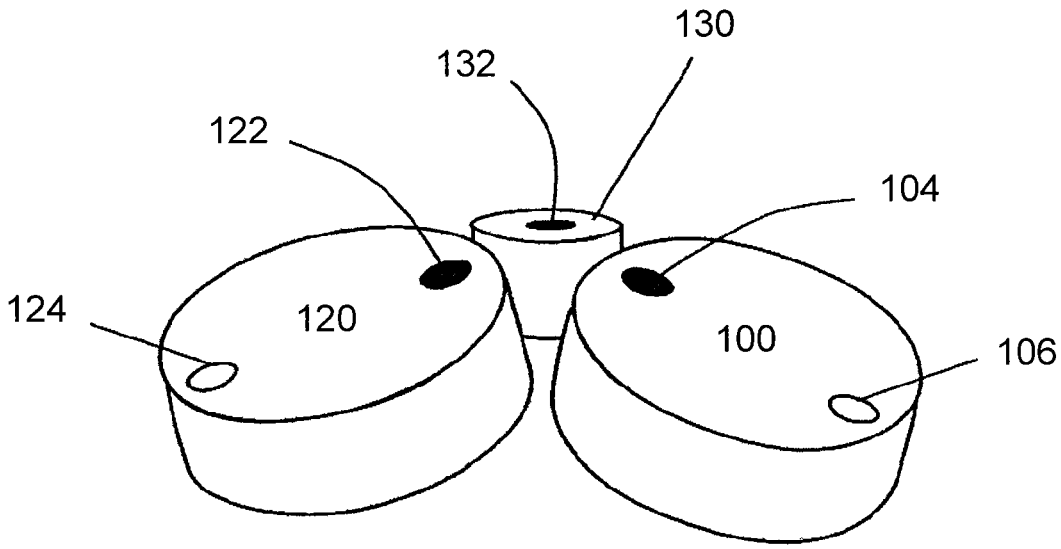
FIG. 4 is a microphone arrangement with gradient transducers and a pressure transducer arranged on an omni surface.

FIG. 4 is an alternative microphone arrangement, in which the two pressure gradient transducers 100, 120 and the pressure transducer 130 are not arranged in a plane, but on an imaginary omni surface. This may occur when the sound inlet openings of the microphone arrangement are arranged on a curved boundary, for example, like the console of a vehicle. The boundary, in which the transducers are embedded, or on which they are fastened, is not shown in FIG. 4.

In the curvature arrangement of FIG. 4, the distance to the center is reduced (which is desirable, because the acoustic centers lie closer together), but the mouthpiece openings may be somewhat or partially shaded. A curved arrangement may alter the directional characteristic of the individual capsules to the extent that figure-eight portion of the signal becomes smaller (from a hypercardioid, then a cardioid). To minimize the adverse effect of shadowing, the curvature may be limited (e.g., not exceed 60°). The pressure gradient capsules 100, 120 may be positioned on the outer surface of an imaginary cone whose surface line encloses with the cone axis an angle of at least 30°.

The sound inlet openings 104, 122 that lead to the front of the diaphragm and the sound inlet opening 132 of the pressure transducer may lie in a plane, referred to as base plane. The sound inlet openings 106, 124, in an arrangement on a curved boundary, lie outside of this base plane. The projections of the main directions of the two gradient transducers 100, 120 into the base plane enclose an angle that is preferably between about 30° and about 150°, with a preferred angle of about 90°.

Like the arrangement where the capsules are arranged in the plane, the main directions of the pressure gradient transducers are inclined relative to each other by an azimuth angle $\phi$, (e.g., they are not only inclined relative to each other in a plane of the cone axis, but the projections of the main directions are also inclined relative to each other in a plane normal to the cone axis).

In the arrangement of FIG. 4, the acoustic centers of the two gradient transducers 100, 120 and the pressure transducer 130 also lie within an imaginary sphere whose radius corresponds to double (or about double) the maximum dimension of the diaphragm of the transducer. By this spatial proximity of the acoustic centers, the coincidence that may be the B-format, is achieved. As in the alternatives to FIG. 1, the capsules depicted in FIG. 4 are also arranged on a boundary, or embedded within it.

Figure 5:
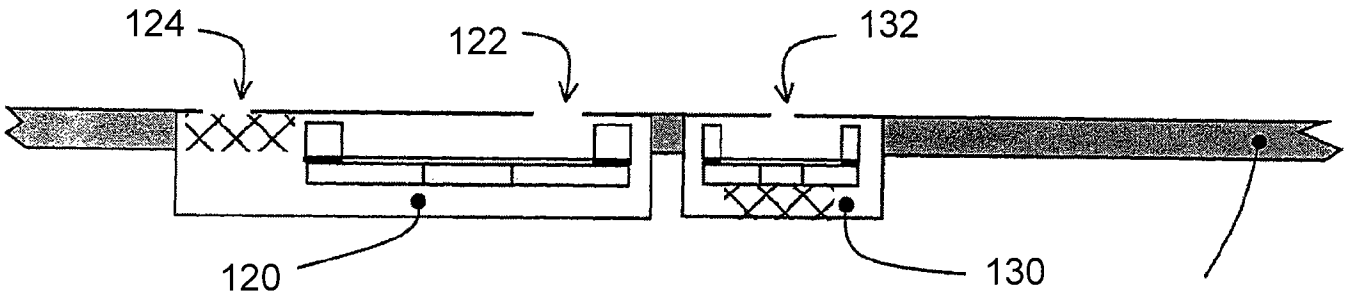
FIG. 5 shows a cross-section through the microphone arrangement of FIG. 1.
Figure 6:
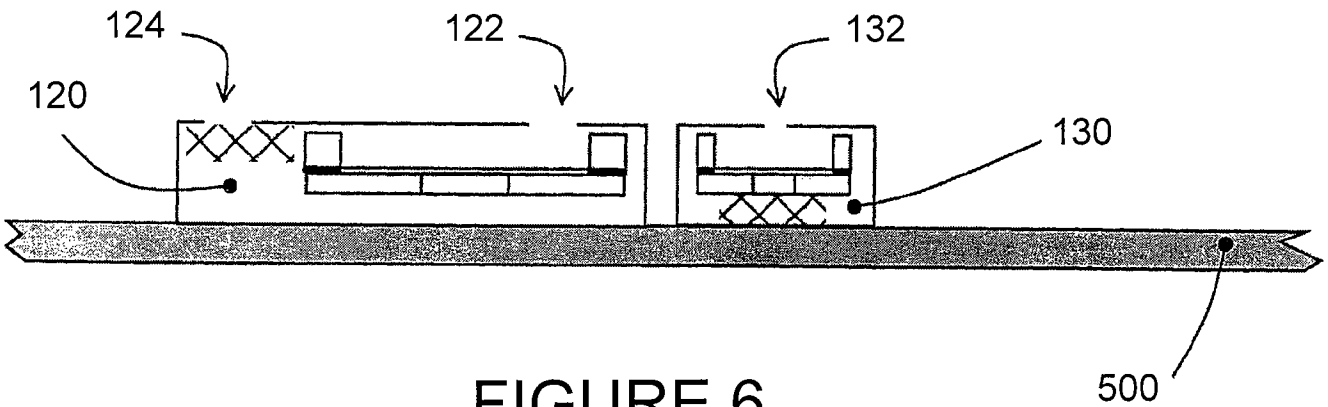
FIG. 6 shows transducers embedded in the boundary.

Boundary arrangements of capsules are shown in FIGS. 5 and 6. The capsules in FIG. 5, which shows a section through the microphone arrangement from FIG. 1, sit on the boundary 500 or are fastened to it, whereas in FIG. 6, they are embedded in boundary 500 and are flush (or substantially flush) with their fronts with boundary 500.

In another alternative system, the pressure gradient capsules 100, 120 and the pressure transducer 130 are arranged within a common housing, with the diaphragms, electrodes, and mounts of the individual transducers being separated from each other by intermediate walls. The sound inlet openings may no longer be seen from the outside. The surface of the common housing, in which the sound inlet openings are arranged, may be a plane (referring to an arrangement of FIG. 1) or a curved surface (referring to an arrangement according to FIG. 2). The boundary may be a plate, console, wall, cladding, etc.

Figure 2:
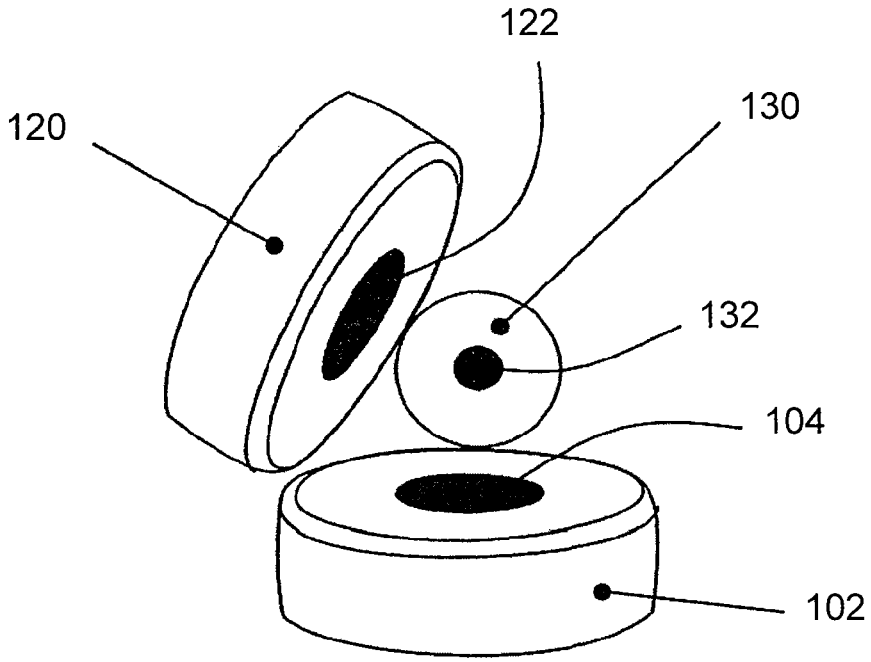
FIG. 2 is an alternative microphone arrangement.
Figure 3:
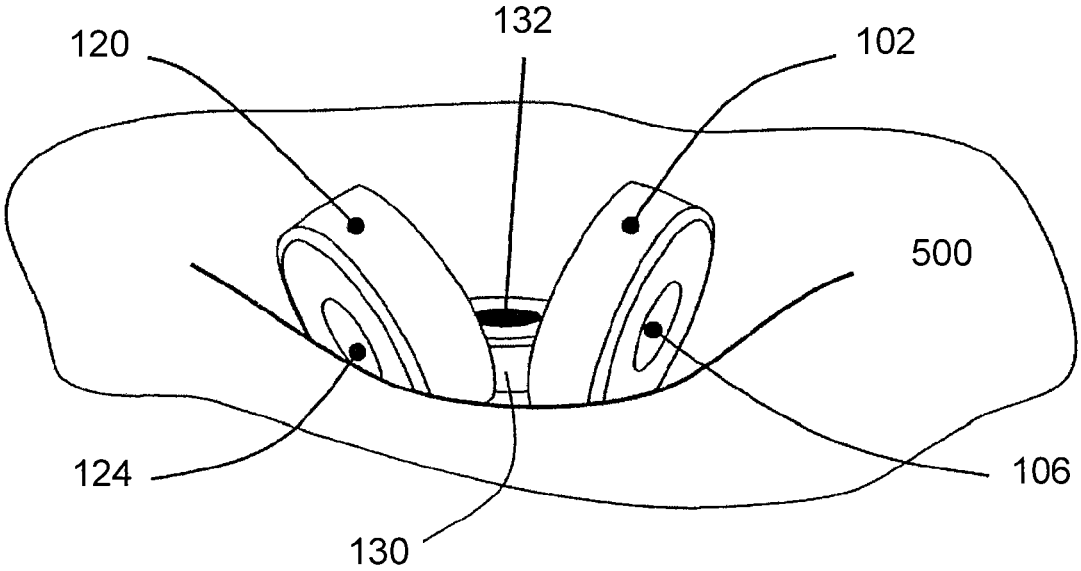
FIG. 3 is an alternative microphone arrangement in which the transducers of FIG. 2 are embedded within a boundary.

FIGS. 2 and 3 show another alternative arrangement that is constructed without a one-side sound inlet microphone. In each of the pressure gradient transducers 102, 120, the first sound inlet openings 104, 122 are arranged on the front of the capsule housing and the second sound inlet openings 106, 124 are arranged on the back of the capsule housing. The pressure transducer 130 has only the sound inlet opening 132 on the front. The first sound inlet openings 104, 122, which lead to the front of the diaphragm, face each other and again. They lie within an imaginary sphere whose radius is equal to about double the largest dimension of the diaphragm of the pressure gradient transducer. The main directions (shown as arrows in FIG. 1) of the two gradient transducers have the microphone arrangement in a common center area. The projections of the main directions, in a plane in which the first sound inlet openings 104, 122 and their center and the sound inlet opening 132 of the pressure transducer 132 lie, established as the base plane, enclose an angle of about 30° to 150°, but preferably 90° or about 90°, with each other. Deviations of ±10° lie within the scope of these arrangements.

FIG. 3 shows an alternative in which the gradient capsules from FIG. 2 are embedded within a boundary 500. It must then be kept in mind that the sound inlet openings are not covered by the boundary 500.

In signal flow, the partial signals W, X, Y, applied in the most often used B-format may be formed from only three capsule signals. A set of signals, including an omni signal and at least two figure eight signals, may now be viewed in a generalized manner as the B-format.

Figure 10:
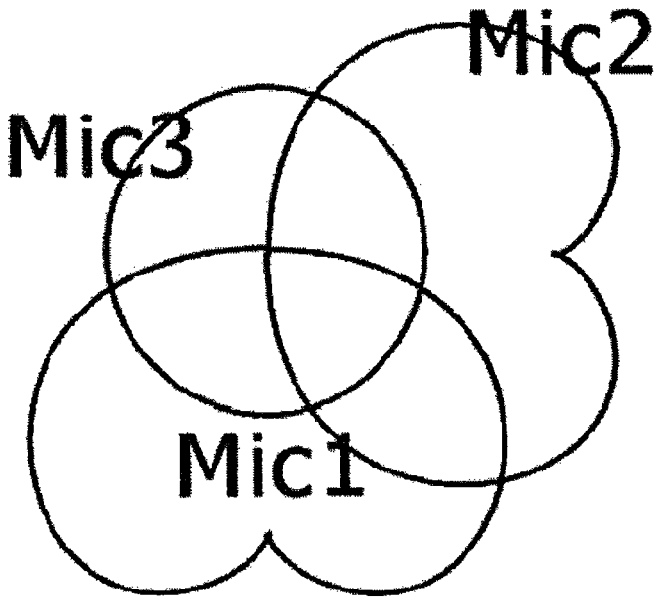
FIG. 10 is the directional characteristics of three transducers, in which the main directions of the pressure gradient transducers enclose an angle of about 90°.

Initially, the formation of a B-format occurs in a microphone arrangement in which the main directions 108, 126 of the two gradient transducers 102, 120 or their projections, in a base plane, enclose an angle of about 90° with each other in the case of a curved boundary. The directional characteristics of the individual transducers 102, 120, 130 in such an arrangement are shown in FIG. 10.

Figure 12:
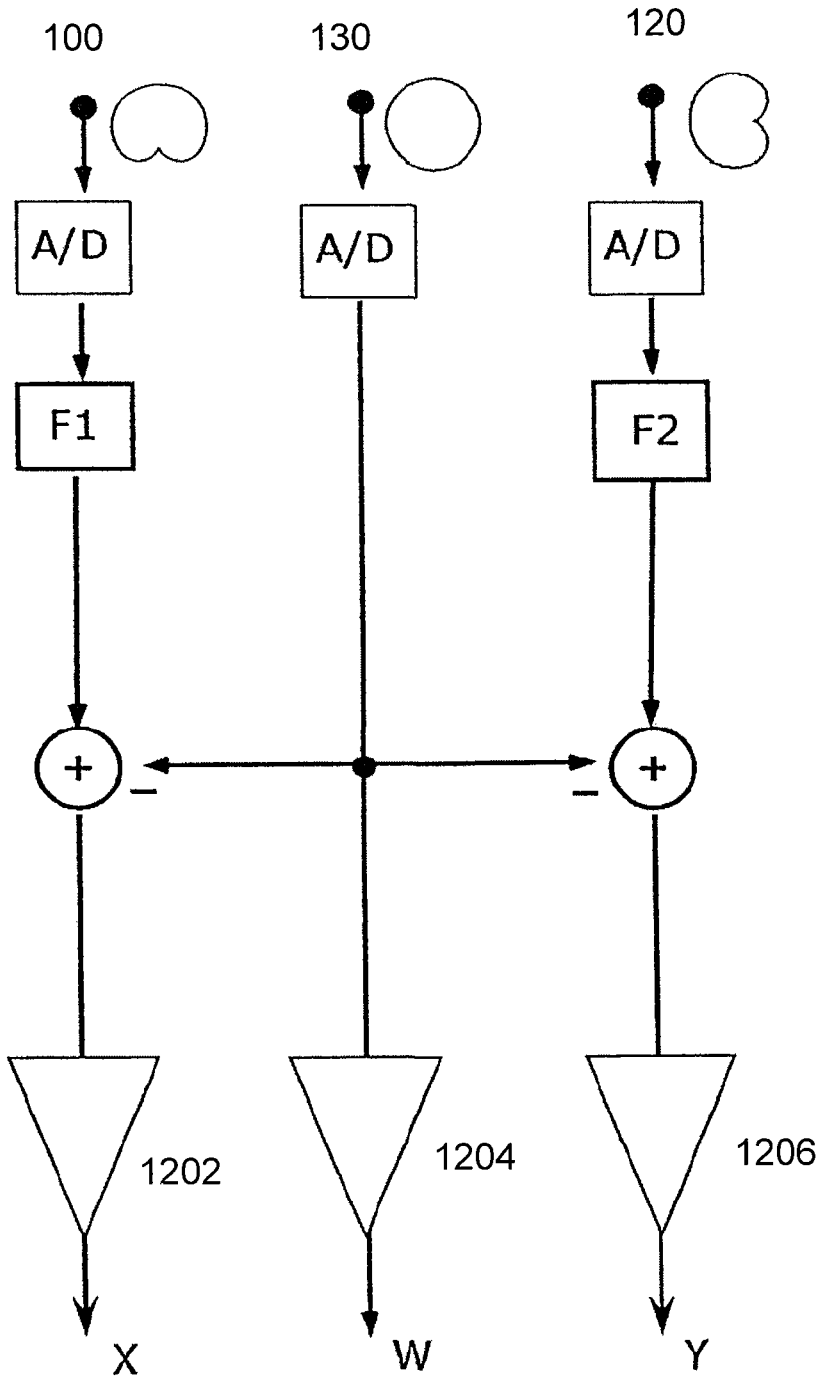
FIG. 12 is a block diagram that renders the B-format signals from the arrangement of FIG. 10.

FIG. 12 shows how a B-format is formed from the individual capsule signals K1, K2 and K3. The B-format includes an omni signal W, an X-component of the B-format, and a Y-component of the B-format. The system extracts a figure-eight signal from each of the gradient signals of transducers 102, 120. This occurs in that the omni portion of the gradient signal is taken off from the gradient signal through the omni signal of the pressure transducer.

Figure 13:
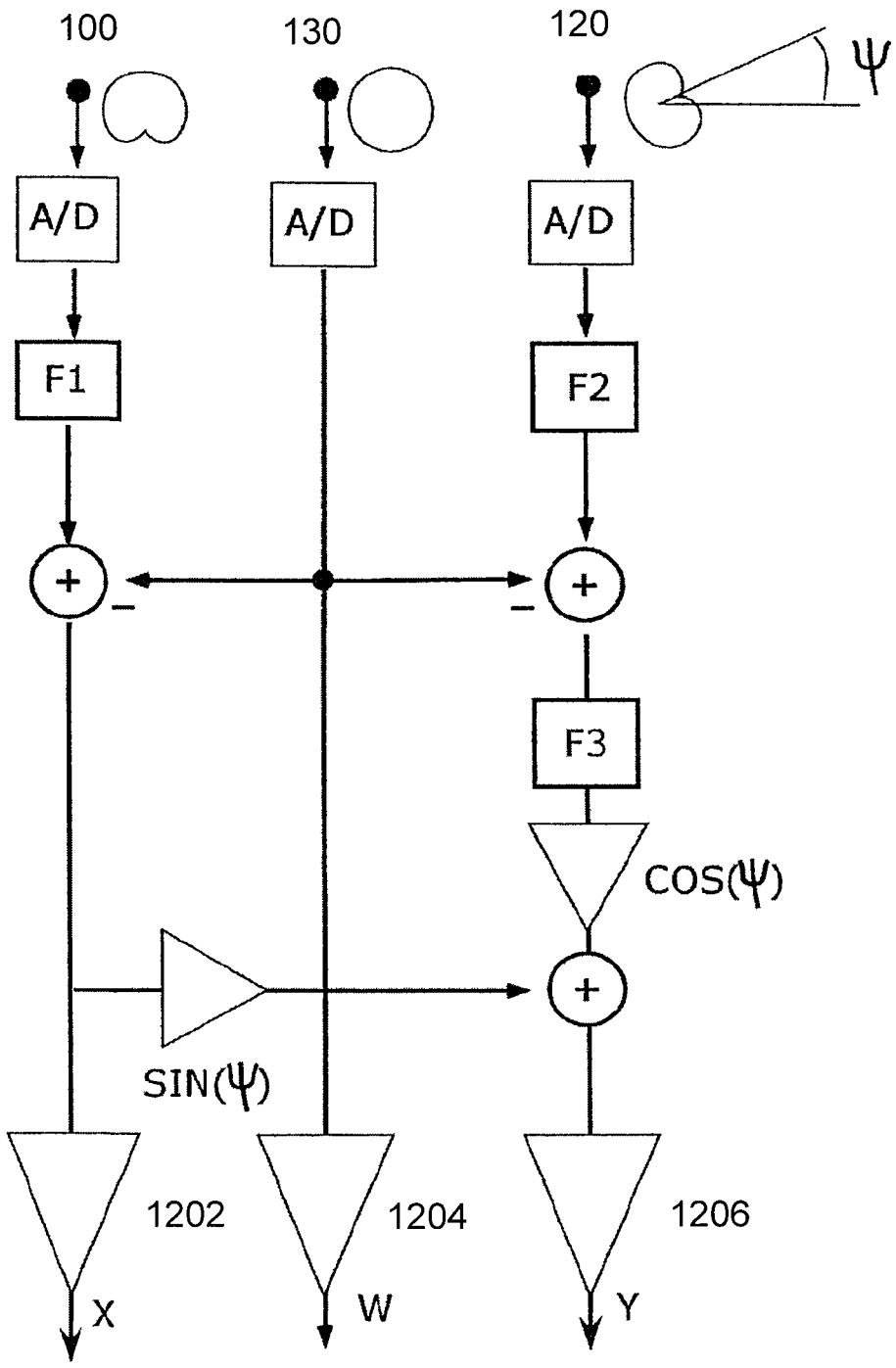
FIG. 13 is a block diagram that renders the B-format signals from an arrangement of FIG. 11.

The calculation starts from linear frequency responses. W, X, and Y may be described as:

$$W=K3$$

$$X=K1-K3$$

$$Y=K2-K3$$

and may be implemented through software stored on a local or remote computer readable storage medium (executed by a processor or signal processor) or the circuit shown FIG. 13. W is the omni signal and X and Y is the orthogonal figure-eight signals.

To subtract the entire omni portion of the gradient signal, normalization of the individual transducer signals may be required. This normalization may occur in different ways, for example, as described.

The characteristics of each individual gradient capsule may also be described by $$Kx = \frac{1}{a_x + b_x}(a_x + b_x\cos(\theta)) \tag{1}$$

in which $a_x$ represents the weighting factor of the omni portion and $b_x$ represents the weighting factor for the gradient portion. For values $a_x$=1, $b_x$=1, cardioid is obtained; for values $a_x$=1 and $b_x$=3, we obtain a hypercardioid is obtained.

If such normalization is carried out, the B-format signals assume the shape described by:

$$W = K3$$

$$X = K1 - K3 * \frac{a_1}{a_1 + b_1}$$

$$Y = K2 - K3 * \frac{a_2}{a_2 + b_2}$$

The directional characteristic of the employed gradient capsules is included in these formulas.

In some applications, gradient capsules may not always be used as a point of departure. They have a linear frequency response over the entire frequency range, and, have a frequency response that differs only in the level during sound exposure from another direction. In these applications, the signals are filtered. In these applications, the signals are filtered before the signals are further processed as shown in FIG. 12. A correction factor F1 is initially calculated, so that the gradient transducer 100, during sound exposure from the main direction (direction of the maximum sensitivity) of the gradient transducer 120, yields the same signal as pressure transducer 3.

The filter coefficients and filter F2 are calculated in the same way. The gradient transducer signal K2 is adapted, so that it may yield the same signal as pressure transducer 130 when exposed to sound from the main direction of the gradient transducer 100 and vice-versa.

Any level differences and/or frequency response differences may then be carried out in channels X, Y and W by the calculation of a corresponding filter 1202, 1204, 1206 (according to the downward-directed triangles).

Figure 11:
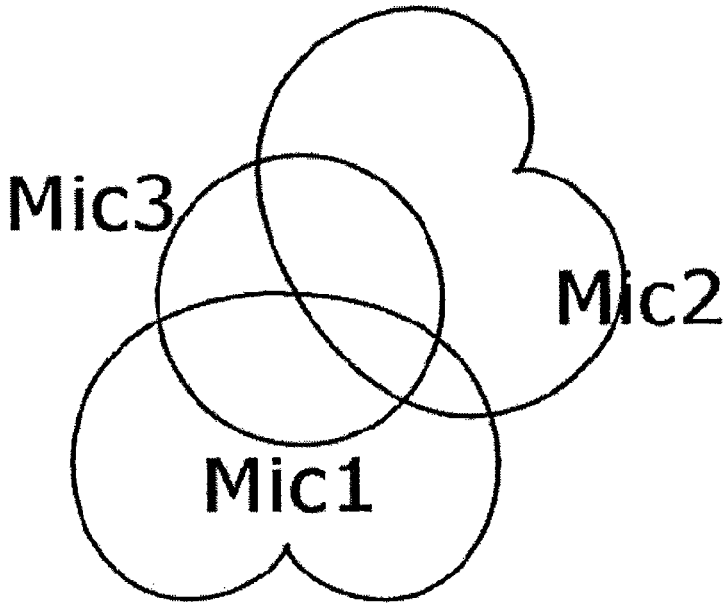
FIG. 11 shows the directional characteristics of three transducers, in which the main directions of the pressure gradient transducers enclose an angle of about 120°.

Formation of the B-format is described below when the main directions of the two gradient microphones 100, 200 have an angle different from about 90° relative to each other. This is further explained by the example shown in FIG. 11 having an angle of about 120°.

If the participating gradient transducers are not situated at an angle of about 90° relative to each other, an additional calculation may ensure that ultimately two substantially orthogonal figure-eight characteristics remain.

FIG. 13 shows how this expansion may occur. The signals are initially adjusted by filtering of the microphone signals of the two gradient transducers 102, 120 with filters F1 and F2, so that after subtraction of the pressure transducer signal from the gradient transducer signal, only the figure-eight portion is left. Another filter F3 ensures that the frequency response of the two figure-eights is identical in the main direction. From each figure-eight signal $R_\psi$, which was extracted from the signal of the gradient transducer 120 by subtraction of the omni portion, and whose directional characteristic is rotated by angle ψ from the 90° position of FIG. 14 a figure-eight signal Y should now be formed, which is orthogonal to the figure-eight signal X of the radiant transducer 102. This occurs by a weighting and superposition of the two figure-eights X and $R_\psi$. The B-format signals W, X, Y so obtained are:

$$W = K3$$

$$X = K1 - K3 * \frac{a_1}{a_1 + b_1}$$

$$Y = X \times \sin(\psi) + R_\psi \times \cos(\psi),$$

in which $$R_\psi = K2 - K3 * \frac{a_2}{a_2 + b_2}$$

Any level differences and/or frequency response differences could be carried out in channels X', Y' and W' by calculation with the corresponding filters 1202, 1204, 1206 (downward-facing triangles).

W represents the omni signal, which is an essentially omni-directional signal. X and Y each represent a figure-eight lobe, whose axis of symmetry is parallel to the plane of the microphone. X and Y are substantially orthogonal to each other and are therefore inclined by about 90° relative to each other. By the combination of omni signal W with at least one of the figure-eight signals X, Y, any arbitrary directional characteristic may be generated. By a linear combination of X and Y with corresponding weighting factors, the figure-eight may be rotated within the x-y-plane. By a linear combination of this rotated figure-eight with the omni signal, the main direction of the synthesized signal may be rotated in different directions.

This linear combination may be written as the synthesized signal $$M(q,r,s)=q\times W+r\times X+s\times Y,$$

in which q, r, s represent the weighting factors, with which the B-format signals are incorporated in the final signal M.

Synthesized microphone signals M1, M2, and optionally M3, serve as the basis, which are calculated by $$M(q,r,s)=q\times W+r\times X+s\times Y.$$

The synthesized signals M1, M2 and M3 now have directional characteristics. These are cardioids, whose main directions lie in one plane and are inclined to each other by about 120°.

Figure 14:
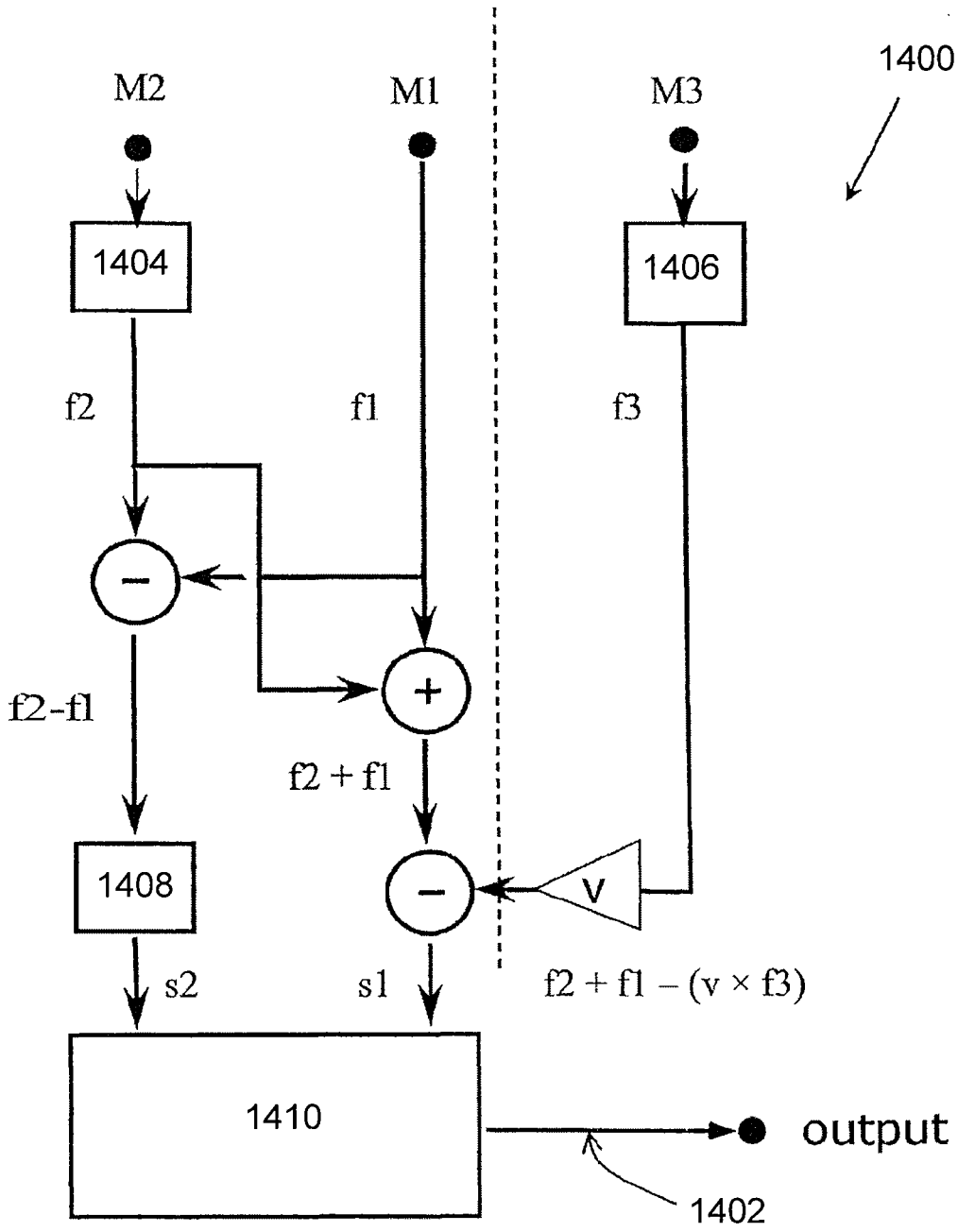
FIG. 14 is an expanded signal processor.

FIG. 14 shows a schematic block diagram between outputs, at which the synthesized signals M1 and M2 lie, and shows the output 1402 of the signal processing unit 1400. The synthesized signals are initially digitized with A/D converters (not shown). Subsequently, the frequency responses of the synthesized signals are compared to each other, to compensate for manufacturing tolerances of the individual capsules. This occurs by linear filters 1404, 1406, which adjust the frequency responses of the synthesized signals M2 and M3 to those of synthesized signal M1. The filter coefficients of linear filters 1404, 1406 are determined from the impulse responses of all participating gradient transducers, with the impulse responses being measured from an angle of about 0°, from the main direction. An impulse response is the output signal of a transducer, when it is exposed to a narrowly limited acoustic pulse in time. In determining the filter coefficients, the impulse responses of transducers 102 and 130 are compared with that of transducer 102. The result of linear filtering of FIG. 14 is that the impulse responses of all gradient transducers 102, 120, 130, after passing through the filter, have the same frequency response. This arrangement serves to compensate for deviations in the properties of the individual capsules.

Subsequently in the block diagram, a sum signal f1+f2 and a difference signal f1−f2 are formed from the filter signals f1 and f2 that result from M1 and M2 by filtering. The sum signal is dependent on the directional characteristic and its orientation in space and therefore dependent on the angle of the main directions of the individual signals M1, M2 relative to each other, and contains a more or less large omni portion.

At least one of the two signals f1+f2 or f2−f1 is now processed in another linear filter 1408. This filtering serves to adjust these two signals to each other, so that the subtraction signal f2−f1 and the sum signal f1+f2, which has an omni portion, have the maximum possible agreement when overlapped.

In this analysis, the subtraction signal f2−f1, which has a figure-eight directional characteristic, is inflated or contracted in filter 1408 as a function of the frequency, so that maximum rejection in the resulting signal occurs when it is subtracted from the sum signal. The adjustment in filter 1408 occurs for each frequency and each frequency range separately.

Determination of the filter coefficients of filters 1408 also occurs via the impulse responses of the individual transducers. Filtering of the subtraction signal f2−f1 gives the signal s2; the (optionally filtered) summation signal f1+f2—in the practical example with only two synthesized signals M1, M2—gives the signal s1 (the portion of the signal processing unit 30, shown on the right side of the dashed separation line, is not present during use of only two signals M1, M2).

However, three synthesized signals M1, M2, M3 may be evolved in signal processing (to the right of the separation line in FIG. 14). The signal f3, adjusted to the frequency response of signal M1 in linear filter 1406, is now multiplied by amplification factor v and subtracted as v×f3 from the sum signal f1+f2. The resulting signal s1 now corresponds to (f1+f2)−(v×f3), in the case of three signals.

It may be initially established by the application factor v, in which the useful direction should lie, (e.g., that spatial direction that is to be strongly limited by the directional characteristic of the synthesized total signal). The possible useful directions are unrestricted, in principle, because the synthesis signals M1, M2 and M3 may be arbitrarily rotated. For example, if factor v is very small, the effect of the third synthesis signal M3 on the total signal is limited and the sum signal f1+f2 dominates relative to signal v×f3. If, on the other hand, the amplification factor v is negative and large, the individual signal v×f3 dominates over the sum signal f1+f2 and the useful sound direction, or the direction in which the synthesized total signal directs its sensitivity. Therefore, that signal rotated by 180° with reference to the former case. By variation of factor v, this system permits a change in sum signals, so that an arbitrary directional characteristic is generated in the desired direction.

This bundling mechanism may be applied to all signal combinations. For the direction to which bundling is supposed to occur, an intrinsic spectral subtraction block may be applied. The signal processing steps occurring before the spectral subtraction block may be combined to the extent that only factor v need be different for two opposite directions. The other preceding steps and branches remain the same for these two directions.

Figure 16:
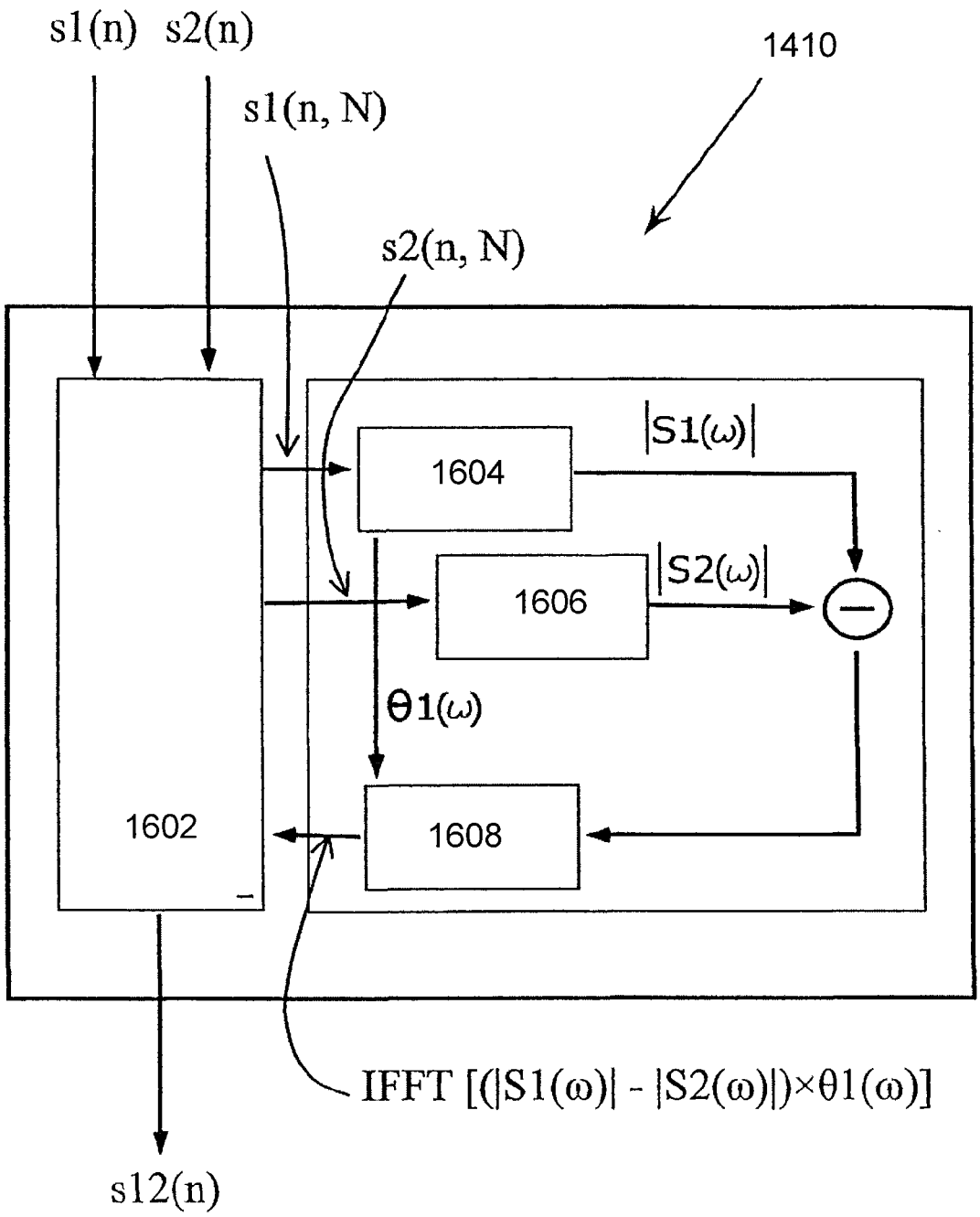
FIG. 16 is a spectral subtraction.

The spectral subtraction applied to the two intermediate signals s1 and s2 occurs in block 1410. FIG. 16 shows the individual components of a spectral subtraction block 1410 in detail in a digital domain. The A/D conversion of the signals also can only occur before spectral subtraction block 1410 and the filtering and signal combinations conducted before occurs on the analog plane.

Two signals s1($n$) and s2($n$) serve as the input of block 1410 in the time range derived from the signals that were recorded at the same time and at the same point (or at least in the immediate vicinity). This guarantees the coincident arrangement of transducers 102, 120, 130. s1($n$) represents the signal that has the most useful signal portions, whereas s2($n$) represents the signal that contains more interference signals, in which signal s2($n$) is characterized by the fact that it has a zero position, in the viewing of the polar diagram, in the useful sound direction; and n represents the sample index, and s(n) therefore corresponds to a signal in the desired time range.

The unit marked 1602 generates individual blocks with a block length N=L+(M−1) from the continuously arriving samples. L represents the number of new data samples in the corresponding block. The remainder (M−1) of samples was also already found in the preceding block. This method is "overlap and save" method.

The N samples contained in a block are then conveyed to unit designated 1604 at the times at which M−1 samples have reached unit 1602 since the preceding block. Unit 1604 is characterized by processing that occurs in a block-oriented manner. The signal s1($n$, N) packed into blocks reaches unit 1604, the unit 1606 is provided for the signal s2($n$, N) packed into blocks in a similar way.

In units 1604, 1606, the end samples of signals s1 and s2 combined into a block, are transformed by FFT (fast Fourier transformation), for example, DFT (discrete Fourier transformation), into the frequency range. The signals S1(ω) and S2(ω) that form are broken into value and phase, so that the value signals |S1(ω)| and |S2(ω)| occur at the output of units 1604 and 1606. By spectral subtraction, the two value signals are now subtracted from each other and produce (|S1(ω)|−|S2(ω)|).

Subsequently, it applies that the resulting signal (|S1(ω)|−|S2(ω)|) is transformed back to the time domain. For this purpose, the phase Θ1(ω), which was separated in unit 1604 from signal S1(ω)=|S1(ω)|×Θ1(ω) and which, like the value signal |S1(ω)|, also has a length of N samples, is used during the back-transformation. The back-transformation occurs in the one unit 1608 through an IFFT (inverse fast Fourier transformation), for example, IDFT (inverse discrete Fourier transformation) and is carried out based on the phase signal Θ1(ω) of S1(ω). The output signal of unit 53 can therefore be represented as IFFT [(|S1(ω)|−|S2(ω)|)×exp(Θ1(ω)].

The generated N samples of long digital time signal S12($n$, N) is fed back to processing unit 1602, where it is incorporated in the output data stream S12($n$) according to the calculation procedure of the overlap and save method.

The parameters obtained in this method are block length N and rate (M−1)/fs [s] (with sampling frequency fs), with which the calculation or generation of a new block is initiated. In principle, in any individual sample, an entire calculation may be carried out, provided that the calculation unit is fast enough to carry out the entire calculation between two samples. In some conditions, about 50 ms has proven useful as the value for the block length and about 200 Hz as the repetition rate, in which the generation of a new block is initiated.

Figure 17:
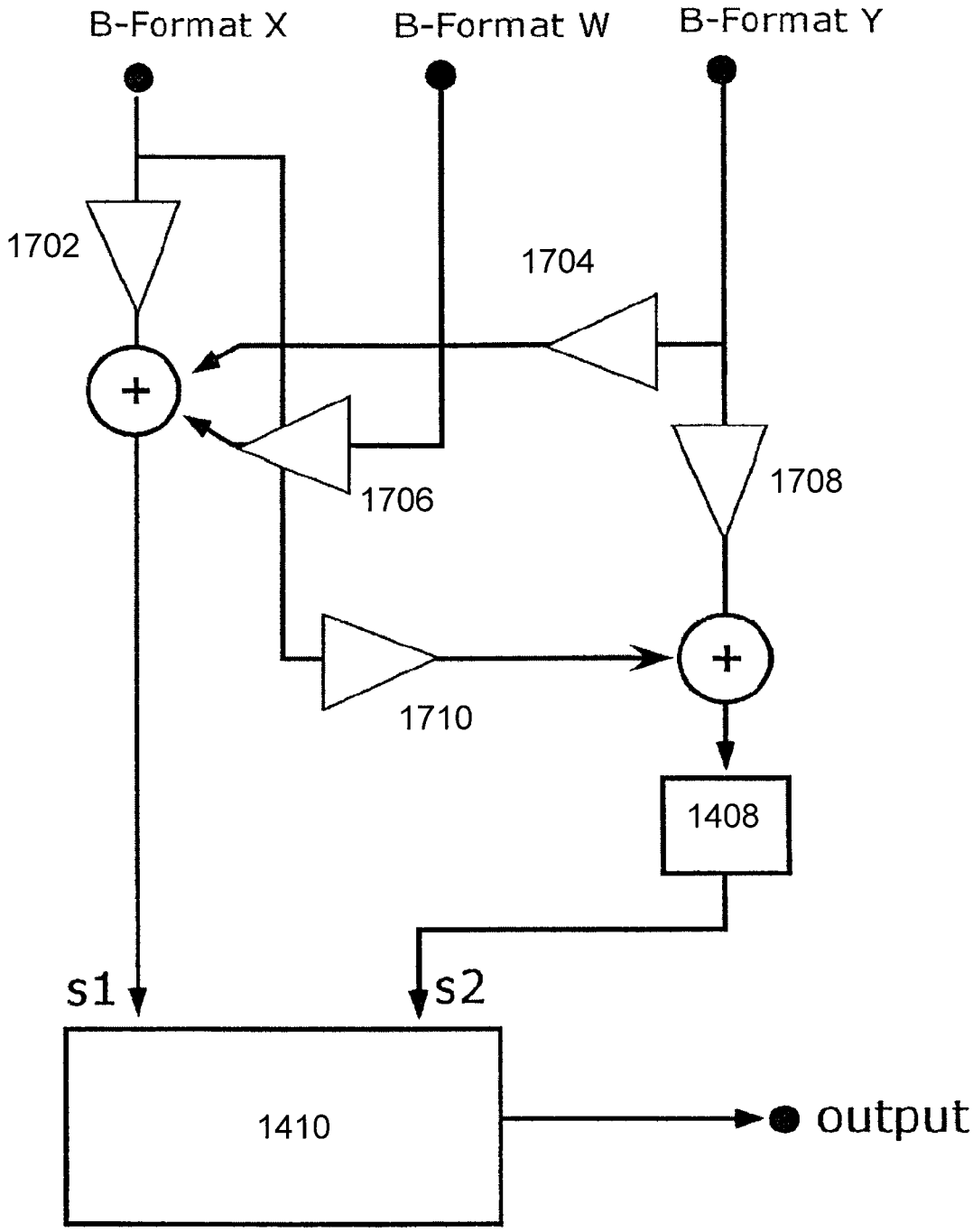
FIG. 17 is a signal processing controller.

The signal processing just described (FIGS. 14 and 15), in which a signal narrowly bundled in a specific direction can be produced, starting from B-format signals, may also be implemented more simply and directly. FIG. 17 shows a corresponding circuit for three B-format signals W, X, Y to the synthesized signals s1 and s2. The subsequent spectral subtraction block 1410 remains. The amplifiers 1702 to 1710 weigh the individual B-format signals according to the direction in which one intends to direct a narrow lobe of the directional characteristic. The filter 1408 ensures that during the spectral subtraction of signal s1 from s2, the resulting signal s12 has minimal energy. The phase of signal s1, which also contains omni portion (W), is used in order to provide the subtracted signal with this phase. This process serves to show the original character of the useful signal. A common feature of FIGS. 14 and 15 and FIG. 17 is that an attempt is made to generate a signal s1 that has an omni portion W, in addition to Figure eight portions X and Y, and the purest possible Figure-of-eight signal s2.

The synthesized output signals s12($n$) contain phase information from the special directions that point to the useful sound source, or are bundled on it; s1, whose phase is used, is the signal that has increasing useful signal portions, in contrast to s2. Through this analysis, the useful signal is not distorted and retains its original sound.

Figure 15:
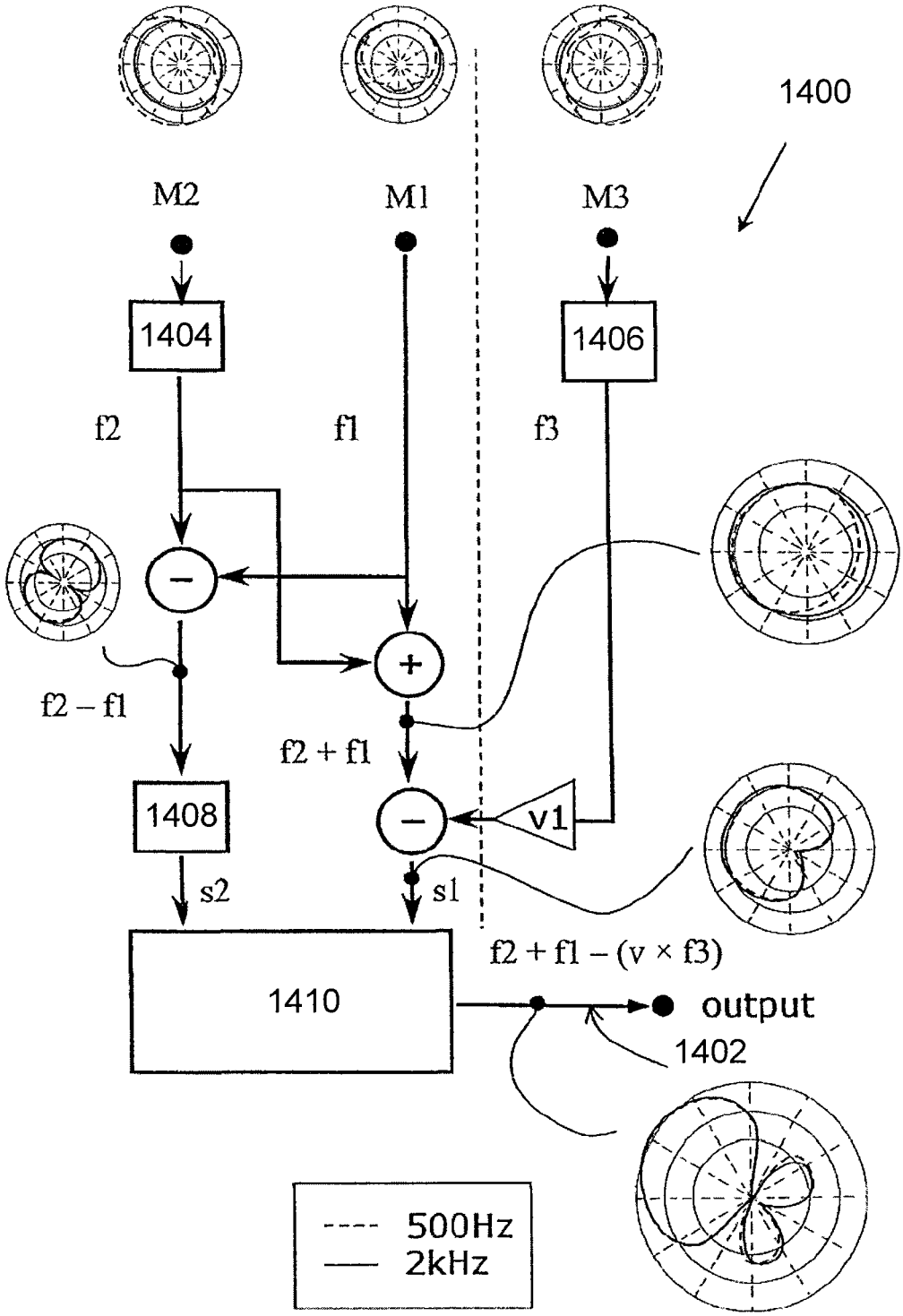
FIG. 15 shows the directional characteristics of FIG. 14.

FIG. 15 shows the synthesized directional characteristics of the individual combined signals M1, M2, M3 and the intermediate signals, in which the amplitudes are in each case normalized to the useful sound direction designated with about 0°, (e.g., all the polar curves and those during sound exposure from a 0° direction are normalized to 0 dB). The output signal 1402 then has a directional characteristic bundled particularly strongly in one direction.

Other alternate systems and methods may include combinations of some or all of the structure and functions described above or shown in one or more or each of the figures. These systems or methods are formed from any combination of structure and function described or illustrated within the figures. Some alternative systems or devices compliant with one or more of the transceiver protocols may communicate with one or more in-vehicle or out of vehicle receivers, devices or displays.

The methods and descriptions described above including those shown in FIGS. 1 and 11-18 may be programmed in one or more controllers, devices, processors (e.g., signal processors). The processors may comprise one or more central processing units that supervise the sequence of micro-operations that execute the instruction code and data coming from memory (e.g., computer memory) that generate, support, and/or complete a compression or signal modifications. The dedicated applications may support and define the functions of the special purpose processor or general purpose processor that is customized by instruction code (and in some applications may be resident to vehicles). In some systems, a front-end processor may perform the complementary tasks of gathering data for a processor or program to work with, and for making the data and results available to other processors, controllers, or devices.

The methods and descriptions may also be programmed between one or more signal processors or may be encoded in a signal bearing storage medium a computer-readable medium, or may comprise logic stored in a memory that may be accessible through an interface and is executable by one or more processors. Some signal-bearing storage medium or computer-readable medium comprise a memory that is unitary or separate from a device, programmed within a device, such as one or more integrated circuits, or retained in memory and/or processed by a controller or a computer. If the descriptions or methods are performed by software, the software or logic may reside in a memory resident to or interfaced to one or more processors or controllers that may support a tangible or visual communication interface, wireless communication interface, or a wireless system.

The memory may include an ordered listing of executable instructions for implementing logical functions. A logical function may be implemented through digital circuitry, through source code, or through analog circuitry. The software may be embodied in any computer-readable medium or signal-bearing medium, for use by, or in connection with, an instruction executable system, apparatus, and device, resident to system that may maintain persistent or non-persistent connections. Such a system may include a computer-based system, a processor-containing system, or another system that includes an input and output interface that may communicate with a publicly accessible distributed network through a wireless or tangible communication bus through a public and/or proprietary protocol.

A "computer-readable storage medium," "machine-readable medium," "propagated-signal" medium, and/or "signal-bearing medium" may comprise any medium that contains, stores, communicates, propagates, or transports software or data for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection having one or more wires, a portable magnetic or optical disk, a volatile memory, such as a Random Access Memory (RAM), a Read-Only Memory (ROM), an Erasable Programmable Read-Only Memory (EPROM or Flash memory), or an optical fiber. A machine-readable medium may also include a tangible medium upon which software is printed, as the software may be electronically stored as an image or in another format (e.g., through an optical scan), then compiled, and/or interpreted or otherwise processed. The processed medium may then be stored in a computer and/or machine memory.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. A microphone arrangement comprising:

a plurality of pressure gradient transducers each having an acoustic center, a first sound inlet opening leading to a front of a diaphragm, and a second sound inlet opening leading to a back of the diaphragm;

a directional characteristic of each of the plurality of pressure gradient transducers comprising an omni portion and a figure-eight portion, the plurality of pressure gradient transducers each having a direction of maximum sensitivity in a main direction, each main direction of the plurality of pressure gradient transducers are inclined relative to each other; and a pressure transducer having a diaphragm and an acoustic center, the acoustic center lying within an imaginary sphere with each of the acoustic centers of the plurality of pressure gradient transducers, the imaginary sphere having a radius corresponding to double the largest dimension of the diaphragm of the pressure transducer or the plurality of pressure gradient transducers.

2. The microphone arrangement of claim 1 where each of the acoustic centers of the pressure gradient transducers and the pressure transducer lay within an imaginary sphere whose radius corresponds to the largest dimension of the diaphragms of the plurality of pressure gradient transducers.

3. The microphone arrangement of claim 1 where the plurality of the pressure gradient transducers and the pressure transducer are arranged within a boundary.

4. The microphone arrangement of claim 1 where projections of the main directions of the plurality of pressure gradient transducers that lie in a base plane that is spanned by the first sound inlet openings of the plurality of pressure gradient transducers and a sound inlet opening of the pressure transducer enclose an angle between 30° and 150°.

5. The microphone arrangement of claim 4 where the projections of the main directions of the plurality of pressure gradient transducers that lie in the base plane that is spanned by the first sound inlet openings of the plurality of pressure gradient transducers and the sound inlet opening of the pressure transducer enclose an angle of about 90° with each other.

6. The microphone arrangement of claim 1 where for each of the plurality of pressure gradient transducers, the first sound inlet opening and the second sound inlet opening are arranged on the same side of a transducer housing.

7. The microphone arrangement of claim 3 where a front of each of the plurality of pressure gradient transducers and a front of the pressure transducer are arranged flush with the boundary.

8. The microphone arrangement of claim 7 where for each of the plurality of pressure gradient transducers the first sound inlet opening is arranged on a front of a transducer housing and the second sound inlet opening is arranged on a back of the transducer housing.

9. The microphone arrangement of claim 1 where the plurality of pressure gradient transducers and the pressure transducer are arranged within a common capsule housing.

10. A microphone arrangement comprising:

a plurality of pressure gradient transducers each having an acoustic center, a first sound inlet opening leading to a front of a diaphragm, and a second sound inlet opening leading to a back of the diaphragm;

a directional characteristic of each of the plurality of pressure gradient transducers comprising an omni portion and a figure-eight portion, the plurality of pressure gradient transducers having a direction of maximum sensitivity in a main direction, each main direction of the plurality of pressure gradient transducers are inclined relative to each other; and a pressure transducer having a diaphragm and an acoustic center, the acoustic center lying within an imaginary sphere with each of the acoustic centers of the plurality of pressure gradient transducers, the sphere having a radius corresponding to double of the largest dimension of the diaphragm of the pressure transducer or the plurality of pressure gradient transducers;

where the first sound inlet openings of the plurality of pressure gradient transducers and a sound inlet opening of the pressure transducer lie in a plane, and the second sound inlet openings of the plurality of pressure gradient transducers lie outside the plane, and where the plurality of pressure gradient transducers consists of two pressure gradient transducers.

11. The microphone arrangement of claim 10 where for each of the plurality of pressure gradient transducers, the first sound inlet opening and the second sound inlet opening are arranged on the same side of a transducer housing.

12. A microphone arrangement comprising:

a plurality of pressure gradient transducers, arranged on an imaginary omni surface, each having an acoustic center, a first sound inlet opening leading to a front of a diaphragm, and a second sound inlet opening leading to a back of the diaphragm;

a directional characteristic of each of the plurality of pressure gradient transducers comprising an omni portion and a figure-eight portion, the plurality of pressure gradient transducers each having a direction of maximum sensitivity in a main direction, each main direction of the plurality of pressure gradient transducers are inclined relative to each other; and a pressure transducer, arranged on the imaginary omni surface, having a single sound inlet, a diaphragm and an acoustic center, the acoustic center lying within an imaginary sphere with each of the acoustic centers of the plurality of pressure gradient transducers, the imaginary sphere having a radius corresponding to double the largest dimension of the diaphragm of the pressure transducer or the plurality of pressure gradient transducers, where the first sound inlet opening of the plurality of pressure gradient transducers and the single sound inlet opening of the pressure transducer face each other.

13. The microphone arrangement of claim 12 where the first sound inlet opening of each of the plurality of pressure gradient transducers is arranged on a front of a transducer housing, and the second sound inlet opening of each of the plurality of pressure gradient transducer is arranged on a back of the transducer housing.

14. The microphone arrangement of claim 12 where projections of the main directions of the plurality of pressure gradient transducers that lie in a base plane that is spanned by the first sound inlet openings of the plurality of pressure gradient transducers and a sound inlet opening of the pressure transducer enclose an angle between 30° and 150°.

15. The microphone arrangement of claim 12 where the plurality of pressure gradient transducers are arranged within a boundary.

* * * * *